US005222928A

United States Patent [19]

Yacullo

[11] Patent Number: 5,222,928

[45] Date of Patent: Jun. 29, 1993

[54] EXERCISING AND BODY TONING APPARATUS

[76] Inventor: Vincent Yacullo, 12 Rutgers La., Parsippany, N.J. 07054

[21] Appl. No.: 936,228

[22] Filed: Aug. 27, 1992

[51] Int. Cl.[5] ..... A63B 69/18; A63B 21/068

[52] U.S. Cl. ..... 482/71; 482/51; 482/95

[58] Field of Search ..... 482/51, 71, 52, 53, 482/79, 95, 96, 121, 122, 123, 131

[56] References Cited

U.S. PATENT DOCUMENTS 3,547,434 12/1970 Ossenkop ..... 482/71
4,340,214 7/1982 Schutzer ..... 482/71

FOREIGN PATENT DOCUMENTS 1443908 12/1988 U.S.S.R. ..... 482/71
2184661 7/1987 United Kingdom ..... 482/71

*Primary Examiner*—Stephen R. Crow
*Attorney, Agent, or Firm*—Mathews, Woodbridge & Collins

[57] ABSTRACT

This invention relates to an apparatus particularly useful for exercising and toning the lower body which apparatus comprises an A-frame assembly defined by a pair of side members converging to an apex, the side members defining a pair of inclined planar surfaces. A foot rest is movably mounted on each inclined planar surface and means is provided to maintain each foot rest in reciprocal relationship to the other as they move along their respective inclined surface in response to the shift in weight of the person using the apparatus, as well as means to vary the resistance to movement of the footrests along said surfaces.

1 Claim, 2 Drawing Sheets

EXERCISING AND BODY TONING APPARATUS

BACKGROUND OF THE INVENTION

It cannot be gainsaid that a regimen of regular exercise is beneficial to the general physical well being of a person. Although outdoor exercise, e.g., walking or jogging is preferable, the vagaries of the weather and other factors often preclude adherence to a regular outdoor exercise program. To this end numerous indoor exercise devices have been developed ranging from the familiar treadmills and stationary bicycles to complex, elaborate apparatus designed to simulate stair climbing or other body exercising functions. Many such complex devices are not only quite expensive but, due to their size are not readily portable or easily storable and moreover, require frequent maintenance.

It is therefore the principal object of this invention to provide a compact, reliable exercise and body toning apparatus, particularly for exercising and toning the lower body, which is both simple to use and usable by persons having a wide range of strength capabilities.

SUMMARY OF THE INVENTION

Generally speaking, this invention relates to an apparatus particularly useful for exercising and toning the lower body which apparatus comprises an A-frame assembly defined by a pair of side members converging to an apex, the side members defining a pair of inclined planar surfaces. A foot rest is movably mounted on each inclined planar surface and means is provided to maintain each foot rest in reciprocal relationship to the other as they move along their respective inclined surface in response to the shift in weight of the person using the apparatus, as well as means to vary the resistance to movement of the footrests along said surfaces.

DESCRIPTION OF THE INVENTION

Figure 1:
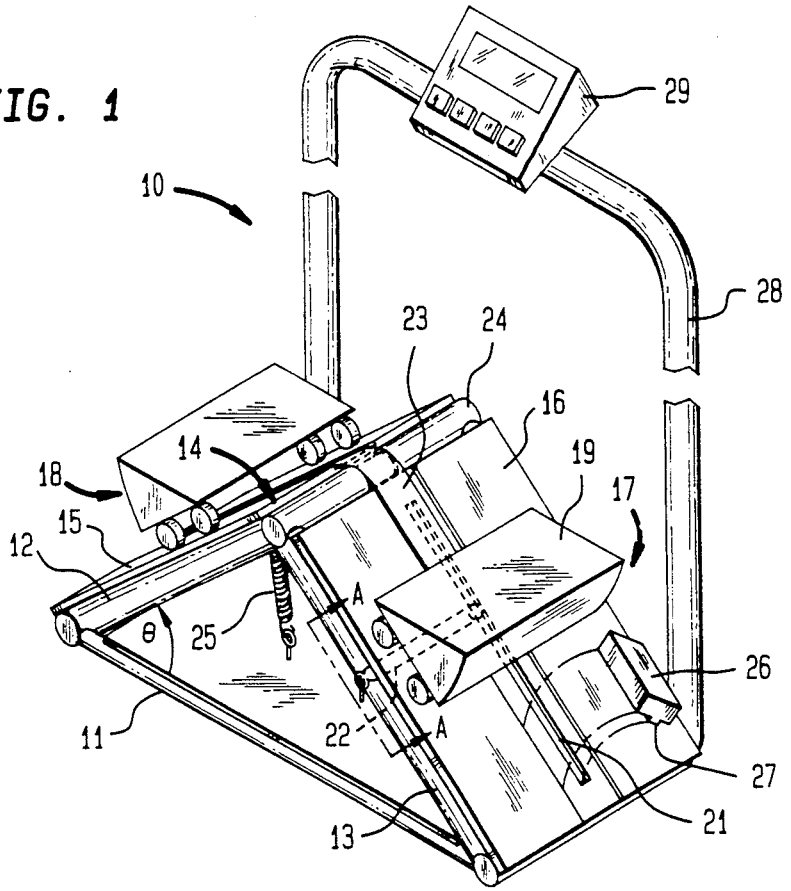
FIG. 1 is a perspective not to scale view of one embodiment of the apparatus of the invention.

With reference to the following description, it is to be understood that the invention is not limited in its application to the details of construction and arrangement of parts illustrated in the drawings since the invention concept is capable of other embodiments and of being modified in various ways which other embodiments and modifications would be apparent to those skilled in the art.

Referring now to FIG. 1, a perspective view of one embodiment of the apparatus of the invention is shown at 10. The apparatus 10 includes a base member 11, a first upwardly extending planar member 12 and a second upwardly extending planar member 13. Each of side members 12 and 13 is secured at its lower end to base 11, the upper ends converging at apex 14. Base 11 and side members 12 and 13 cooperate to form an A-frame or isosceles triangle shaped assembly with side members 12 and 13 forming a pair of mirror image inclined planar surfaces 15 and 16 respectively.

The angle Θ between base 11 and side members 12 and 13 may vary from about 30° to about 60°, preferably from about 35° to 45°. However, for optimal results the angle Θ is from 38° to 40° with an apparent optimum of 39°. The dimensions of the frame assembly are, of course, determined by the angle Θ between the base and the side members. For purposes of illustration, a working prototype of the invention apparatus has a base measuring about 12×37 inches and a height from the base to the apex of about 16 inches.

For safety purposes, a suitable handrail 28 may be provided as well as a suitable digital display console 29 for timing the length of the exercise period as well as other factors, e.g., pulse rate, relative resistance, and the like.

Associated with planar surface 16 and longitudinally movable with respect thereto is a foot rest 17 and associated with planar surface 15 and longitudinally movable with respect thereto is foot rest 18. Each of foot rests 17 and 18 are identically constructed and operable. Consequently for purposes of clarity the description of the construction and operation of the foot rests will be with reference to foot rest 17 associated with planar surface 16.

Figure 2:
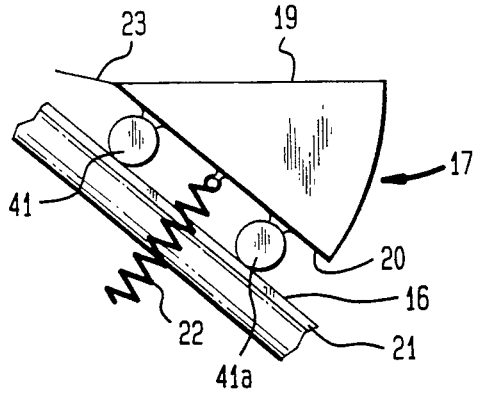
FIG. 2 is a view along the line A—A of FIG. 1.

Foot rest 17 is generally wedge shaped and has top surface 19 generally parallel to the plane of the base 11 or the ground on which it rests and a bottom surface 20 generally parallel to the inclined planar surface 16. Planar surface 16 has a longitudinally extending groove 21 formed therethrough defining a track along which foot rest 17 is movable from base 11 to apex 14 and vice versa. Movability of foot rest 17 along planar surface 16 is enhanced by the provision of wheels or roller assemblies 41 and **41*a* secured to bottom surface 20 of foot rest 17 as shown in FIG. 2. Other means may of course be used in place of wheels or rollers to enhance movability. For example a tongue (not shown) may be formed on the bottom surface 20 of foot rest 17 which tongue is adapted to slidably engage groove 21**.

To restrain lateral movement of the footrests, a groove or track (not shown) may be formed in the respective inclined surface which groove or track is adapted to accommodate wheels or rollers 41, **41*a*. Alternatively groove 21** may be widened to form a raceway to accommodate the wheels or rollers.

To bias foot rest 17 against planar surface 16 and to provide resistance to the movability of foot rest 17, tensioning means is provided in the form of a coil spring 22, one end of which is attached by suitable means to the bottom surface 20 of foot rest 17 and the other end is attached to base 11. In place of the coil spring 22, other tensioning means may of course be used, for example, a hydraulic piston and cylinder (not shown) or elastic bands (not shown).

Foot rest 17 is also functionally linked to foot rest 18 by means of belt 23 which is secured to the inner end of foot rests 17 and 18 and which passes over rotatable or fixed bearing means 24 provided at apex 14. Belt 23 is made of non-resilient material such as leather, canvas or the like and serves to maintain each foot rest in spaced reciprocal relationship to the other as they move along their respective planar surfaces in response to the shift in weight of the person using the apparatus. Of course other means linking foot rests 17 and 18 in functional, reciprocal relationship may be used, e.g., cable or rope.

Figure 3A:
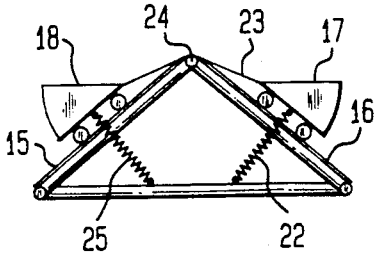
FIGS. 3A, 3B and 3C are schematic front elevations showing the mode of operation of the apparatus of the invention.
Figure 3B:
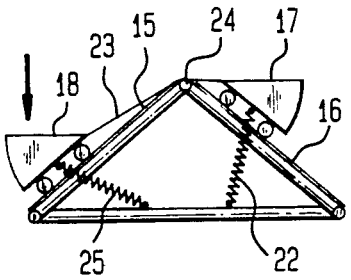
Figure 3C:
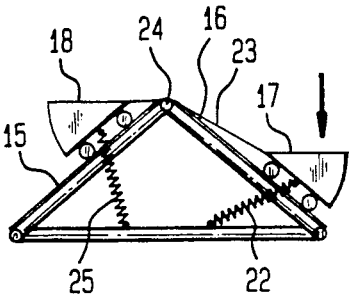

Operation of the invention apparatus is illustrated with reference to FIGS. 3A, 3B, and 3C. FIG. 3A shows the apparatus at rest position wherein foot rests 17 and 18 are at about the midpoint of planar surfaces 15 and 16, being maintained thereat by coil springs 22 and 25 and belt 23. With reference to FIG. 3B, as the person standing on foot rests 17 and 18 shifts his or her weight to the left, foot rest 18 moves down planar surface 15 elongating spring 25 while foot rest 17 moves up planar surface 16 elongating spring 22, the foot rests being maintained in spaced reciprocal relationship via linkage 23. With reference to FIG. 3C, as the person shifts his or her weight to the right, foot rest 17 moves down planar surface 16 elongating spring 22 and foot rest 17 moves up planar surface 16 elongating spring 25. This alternating weight shifting motion and reciprocal action of the foot rests continues for the duration of the exercise.

To compensate for the differences in the relative strengths of persons using the apparatus, the resistance to movement of the foot rests along their respective inclined planes can of course be varied. One such means of varying such resistance is that of using progressively stronger springs or other resilient means or a plurality of springs or other resilient means. Also to compensate for differences in height of persons using the apparatus, means may be provided to limit the extent of travel of the foot rests along their respective planar surfaces. One such means is illustrated in FIG. 1 wherein a shim or block 26 provided with a tongue 27 formed on its underside may be inserted into groove 21 thus limiting the length of travel of the foot rest.

As beforementioned the apparatus of the invention is particularly suited to exercising and toning the legs and lower body but its uses are not limited thereto. For example, rather than standing square to the apparatus, one may stand sidewise. Alternatively, one may kneel on the floor and manipulate the foot rests with the palms of the hands rather than the soles of the feet.

Figure 4:
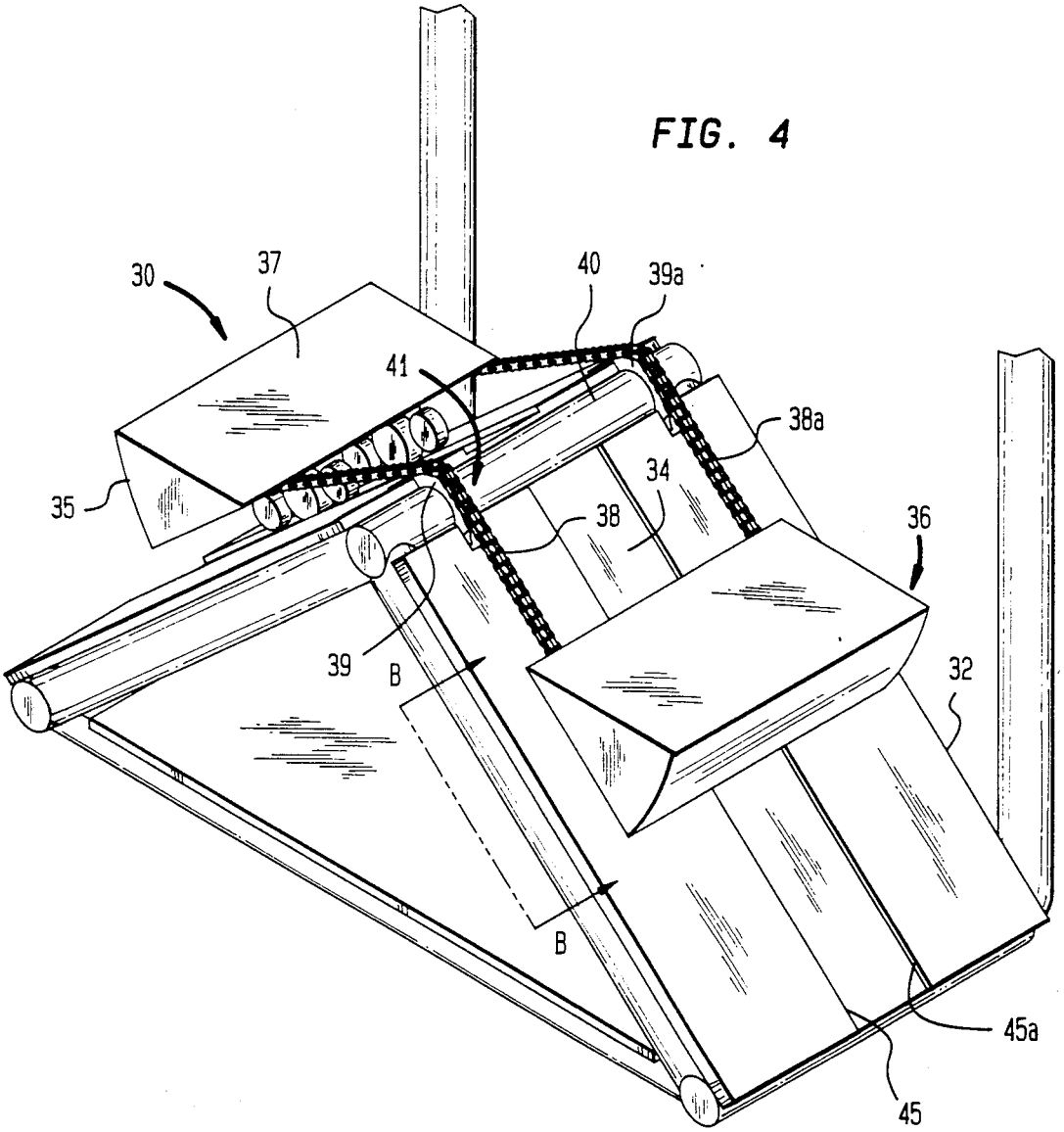
FIG. 4 is a perspective not to scale view of another embodiment of the apparatus of the invention.

Another embodiment of the invention apparatus is illustrated in FIG. 4. As with the apparatus illustrated in FIG. 1, an A-frame assembly 30 is provided composed of a pair of upwardly extending and converging planar members 32 and 33 which define mirror image planar surfaces 34 and 35 along which are movably mounted, foot rests 36 and 37, respectively. Foot rests 36 and 37 are linked each to the other and maintained in spaced reciprocal relationship each to the other by a pair of chains 38 and 38*a*, e.g. bicycle-type chains, secured at the front inner edges of the foot rests. Chains 38 and 38*a* respectively engage a pair of sprockets 39 and 39*a*. Each of sprockets 39 and 39*a* are rigidly affixed to a shaft 40 which is rotatably disposed at apex 41 of frame assembly 30.

As with the apparatus of FIG. 1, provision of wheels or roller assemblies on the undersurface of the foot rests is the preferred means of enhancing movability of the foot rests along their respective planar surfaces.

It should be noted that the apparatus depicted in FIG. 4 dispenses with the need for provision of separate elastic tensioning means such as coil springs, or the like, as depicted and described with reference to the embodiment shown in FIG. 1. The freedom of rotation of shaft 40 and associated sprockets 39 and 39*a* can be readily controlled and adjusted by providing an adjustable shoe or bearing plate (not shown) which can be friction tightened against either of the sprockets thus regulating the rotation of shaft 40 and thus providing a means of varying the resistance to movement of the foot rests along their respective inclined planar surfaces.

Figure 5:
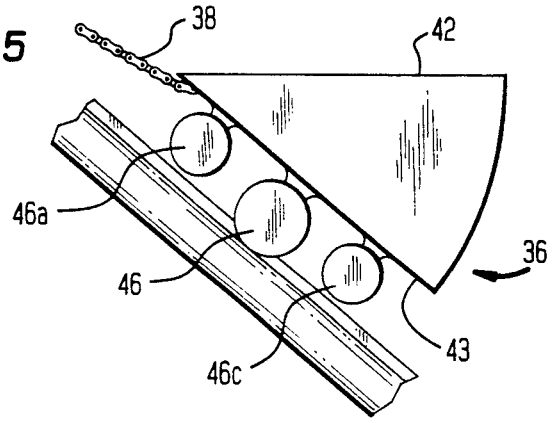
FIG. 5 is a view along the line B—B of FIG. 4.

In its downward movement along its respective inclined surface, the upper planar surface of the foot rest should be and preferably is parallel to the plane of the base or ground upon which the apparatus rests. In its upward movement along the inclined surface the upper planar surface of the foot rest may desirably and preferably tilt or rock upwardly and inwardly, the extent of such tilt or rock preferably not exceeding about 2½° from the horizontal. To effect this tilting or rocking motion, the wheels may be configured as shown in FIG. 5. In FIG. 5, three wheel assemblies are provided on the underside of foot rest 36, namely forward wheel assembly 46*a*, main wheel assembly 46 and trailing wheel assembly 46*c*, main wheel assembly being somewhat of a larger diameter than both of forward wheel assembly 46*a* and trailing wheel assembly 46*c*. In operation main wheel assembly 46 functions as a fulcrum or pivot point so as to provide a maximum of about 2½° upward, inward tilt to the foot rest during its upward movement along the inclined surface and to maintain the upper surface of the foot rest in parallel relationship to the plane of the base or ground during its downward movement along the inclined surface. It is also to be appreciated that biasing means such as springs or the like may be provided to maintain wheel assemblies 46*a* and 46*c* in contact with the inclined surface at all times while still enabling the desired rocking or tilting motion.

Regarding materials of construction, the invention apparatus may be fabricated of wood, metal, plastic or combinations thereof so long as the apparatus has adequate structural integrity for its intended use.

Also, even though the inclined surfaces along which the foot rests are movable are depicted as generally planar surfaces, the same may have an arcuate or bowed shape, in which case the apparatus, when viewed in side section as shown, e.g., in FIG. 3 would have an arched rather than an A-framed shape.

Having described the apparatus of the invention with reference to the embodiments illustrated herein, it is intended that the same not be limited thereby, since variations therein may occur to one skilled in the art without departing from the spirit and scope thereof as defined in the appended claims.

I claim:

1. Apparatus for exercising and toning the body comprising:

an A-frame assembly defined by a pair of upwardly extending side members converging to an apex, thus defining a pair of mirror image inclined surfaces;

a foot rest movably mounted on each inclined surface including tensioning means operable to vary the resistance to movement of each foot rest along its associated planar surface and means operable to maintain each foot rest in spaced reciprocal relationship to the other, as they move along their respective inclined surfaces in response to the shift in body weight of the person using the apparatus.

* * * * *